US007406156B2

(12) United States Patent
Lenz

(10) Patent No.: US 7,406,156 B2
(45) Date of Patent: Jul. 29, 2008

(54) X-RAY TUBE

(75) Inventor: Eberhard Lenz, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/504,839

(22) Filed: Aug. 15, 2006

(65) Prior Publication Data

US 2007/0041503 A1 Feb. 22, 2007

(30) Foreign Application Priority Data

Aug. 18, 2005 (DE) ..... 10 2005 039 188

(51) Int. Cl.
*H01J 35/12* (2006.01)
*H01J 35/10* (2006.01)

(52) U.S. Cl. ..... 378/142; 378/141; 378/143; 378/144; 378/127

(58) Field of Classification Search ..... 378/141–144, 378/127
See application file for complete search history.

(56) References Cited

U.S. PATENT DOCUMENTS

| | | | | |
|---|---|---|---|---|
| 2,125,896 | A * | 8/1938 | Driggs et al. | 378/143 |
| 2,345,722 | A * | 4/1944 | Atlee | 313/40 |
| 2,790,102 | A * | 4/1957 | Atlee | 313/32 |
| 2,829,271 | A * | 4/1958 | Boucher | 378/142 |
| 3,795,832 | A * | 3/1974 | Holland | 378/127 |
| 3,842,305 | A * | 10/1974 | Braun | 378/127 |
| 3,894,863 | A * | 7/1975 | Lachman et al. | 148/400 |
| 3,959,685 | A * | 5/1976 | Konieczynski | 378/144 |
| 3,969,131 | A * | 7/1976 | Fatzer et al. | 378/144 |
| 4,103,198 | A * | 7/1978 | Braun | 378/125 |
| 4,271,372 | A | 6/1981 | Geldner et al. | |
| 4,392,238 | A * | 7/1983 | Lersmacher et al. | 378/144 |
| 4,461,019 | A * | 7/1984 | Lersmacher | 378/125 |
| 5,157,706 | A * | 10/1992 | Hohenauer | 378/144 |
| 5,208,843 | A * | 5/1993 | Marumo et al. | 378/125 |
| 5,541,975 | A * | 7/1996 | Anderson et al. | 378/130 |
| 5,673,301 | A * | 9/1997 | Tekriwal | 378/130 |
| 5,943,389 | A | 8/1999 | Lee | |
| 6,256,376 | B1 * | 7/2001 | Benz et al. | 378/144 |
| 6,477,236 | B1 * | 11/2002 | Anno et al. | 378/144 |

(Continued)

FOREIGN PATENT DOCUMENTS

| | | |
|---|---|---|
| DE | 2 154 888 | 5/1973 |

(Continued)

OTHER PUBLICATIONS

Arkhipov, et al., Deuterium retention in codeposited layers and carbon materials exposed to high flux D-plasma, 1999, Elsevier-Journal of Nuclear Materials, vol. 271-272, pp. 418-422.*

(Continued)

*Primary Examiner*—Edward J. Glick
*Assistant Examiner*—Anastasia Midkiff
(74) *Attorney, Agent, or Firm*—Schiff Hardin LLP

(57) ABSTRACT

An x-ray tube has a cathode and an anode produced from a first material, the anode having a heat conductor element on the first side thereof facing away from the cathode. To improve the performance of the x-ray tube, the heat conductor element is composed of graphite doped with titanium having a heat conductivity of at least 500 W/mK.

10 Claims, 2 Drawing Sheets

U.S. PATENT DOCUMENTS

| | | | | |
|---|---|---|---|---|
| 6,799,627 | B2 * | 10/2004 | Ray et al. | 164/529 |
| 6,933,531 | B1 * | 8/2005 | Ishikawa et al. | 257/76 |
| 7,127,035 | B2 * | 10/2006 | Anno et al. | 378/133 |
| 7,197,119 | B2 * | 3/2007 | Freudenberger et al. | 378/141 |
| 7,279,023 | B2 * | 10/2007 | Pickard et al. | 75/243 |
| 2001/0036249 | A1 * | 11/2001 | Benz et al. | 378/144 |
| 2002/0041959 | A1 * | 4/2002 | Kawai et al. | 428/375 |
| 2004/0013234 | A1 * | 1/2004 | Kutschera | 378/144 |
| 2004/0191495 | A1 | 9/2004 | Lenz | |
| 2005/0213711 | A1 * | 9/2005 | Ukita | 378/141 |
| 2007/0064874 | A1 * | 3/2007 | Lenz | 378/144 |
| 2007/0086574 | A1 * | 4/2007 | Lenz | 378/143 |
| 2008/0026219 | A1 * | 1/2008 | Tsushima et al. | 428/367 |

FOREIGN PATENT DOCUMENTS

| | | | |
|---|---|---|---|
| DE | 196 50 061 | | 6/1997 |
| WO | WO 03/043046 | | 5/2003 |
| WO | WO 2006017074 | A2 * | 2/2006 |

OTHER PUBLICATIONS

Oku et al., Effects of Titanium impregnation on the thermal conductivity of carbon/copper composite materials, 1998, Elsevier-Journal of Nuclear Materials, vol. 257, pp. 59-66.*

Zhang et al., Effects of dopants on properties and microstructure of doped graphite, 2002, Elsevier-Journal of Nuclear Materials, vol. 301, pp. 187-192.*

Lopez-Galilea, et al., Improvement of Thermal Shock Resistance of Isotopic Graphite by Ti-doping, 13th International Conference on Fusion Reactor Materials, Nice, Dec. 10-14, 2006.*

* cited by examiner

X-RAY TUBE

BACKGROUND OF THE INVENTION

1. Field of the Invention

The present invention concerns an x-ray tube of the type having a cathode and an anode produced from a first material, wherein the anode, at a first side thereof facing away from the cathode, has at least sections containing a heat conductor element produced from a second material exhibiting a higher heat conductivity than said first material, for dissipating heat.

2. Description of the Prior Art

An x-ray tube of the above general type is known. An anode made of a first material is produced, the material typically being formed from a metal exhibiting a high melting point. On a side facing away from the cathode, the anode is provided at least in sections with a layer for dissipation of heat. The layer is produced from a second material which exhibits a higher heat conductivity than the first material. Such anodes are used in conventional designs of x-ray tubes, for example in x-ray tubes with fixed anodes, rotary anodes or in rotary piston tubes.

The performance of x-ray tubes is in particular limited by the thermal capacity of the anode. To increase the thermal capacity of the anode, according to the prior art various designs are known in which it is sought to distribute the heat introduced by the decelerated electron beam over an optimally large area. X-ray tubes with rotary anodes and rotary piston tubes are examples of such designs. It has also been attempted with a number of different designs to cool the anode as efficiently as possible. An increase in the performance of x-ray tubes can thereby be achieved.

SUMMARY OF THE INVENTION

An object of the invention to provide an x-ray tube with further improved performance.

This object is achieved according to the invention in an x-ray tube of the type initially described wherein the second material is graphite doped with titanium, exhibiting a heat conductivity of at least 500 W/mK. A significantly improved dissipation of heat from the anode can therewith be realized. The performance of the x-ray tube can be improved by up to 15%.

Graphite doped with titanium at room temperature exhibits a heat conductivity of at least 680 W/mK in at least two crystallographic planes. The heat conductivity of the proposed graphite is notably higher than the heat conductivity of conventional graphite or of copper. It has proven to be advantageous to orient the graphite in the heat conductor elements such that at least one crystallographic plane exhibiting the aforementioned high heat conductivity is oriented essentially perpendicularly to the first side.

According to a further embodiment of the invention, the heat conductor element is accommodated in a carrier structure produced from copper. The carrier structure can be a component of the anode produced from the first material, or it can be a separate component that accommodates the heat conductor element and is mounted on the first side.

According to a further embodiment the first material is selected from the following group: Cu, Rh, Mo, Fe, Ni, Co, Cr, Ti, W or an alloy that predominantly contains one of the aforementioned metals. Such a first material exhibits a particularly high melting point and enables an operation of the anode at high temperatures.

According to a further embodiment, on its second side facing toward the cathode the anode, at least in a focal zone on that side, has a layer formed of a third material, the third material exhibits a lower vapor pressure than the first material at a temperature of 800° C. An unwanted ablation of the first material thus can be prevented given operation of the anode at high temperatures. As a result no accretions of the first material can precipitate on the x-ray exit window of the tube housing, such accretions disadvantageously absorbing x-ray radiation. The proposed x-ray tube thus can be durably operated at high anode temperatures without performance loss.

The third material is appropriately selected from the following group: SiO2, $TiO_2$, CrN, TaC, HfC, WC, WB, W, Re, TiB, HfB, TiAlN, TiAlCN, B, Co, Ni, Ti, V, Pt, Ta. The cited compounds are characterized by a very low formation enthalpy and therewith (according to general practical experience) by a particularly low vapor pressure.

In a further embodiment, the $SiO_2$ can be provided with filling material produced from carbon or $TiO_2$. This embodiment variant is characterized by an improved stability of the third material, in particular at high temperatures. The layer can exhibit a thickness in the range of 0.2 to 1.0 μm. A thickness of the layer in the range from 0.3 to 0.8 μm has proven to be particularly advantageous.

The anode can be a fixed anode or a rotary anode that can be rotated relative to the cathode. The anode may also be a component of a rotary piston tube. Particularly high efficiencies can be achieved given a use of the inventive anode as a component of a rotary anode or of a rotary piston tube.

DESCRIPTION OF THE PREFERRED EMBODIMENTS

Figure 1:
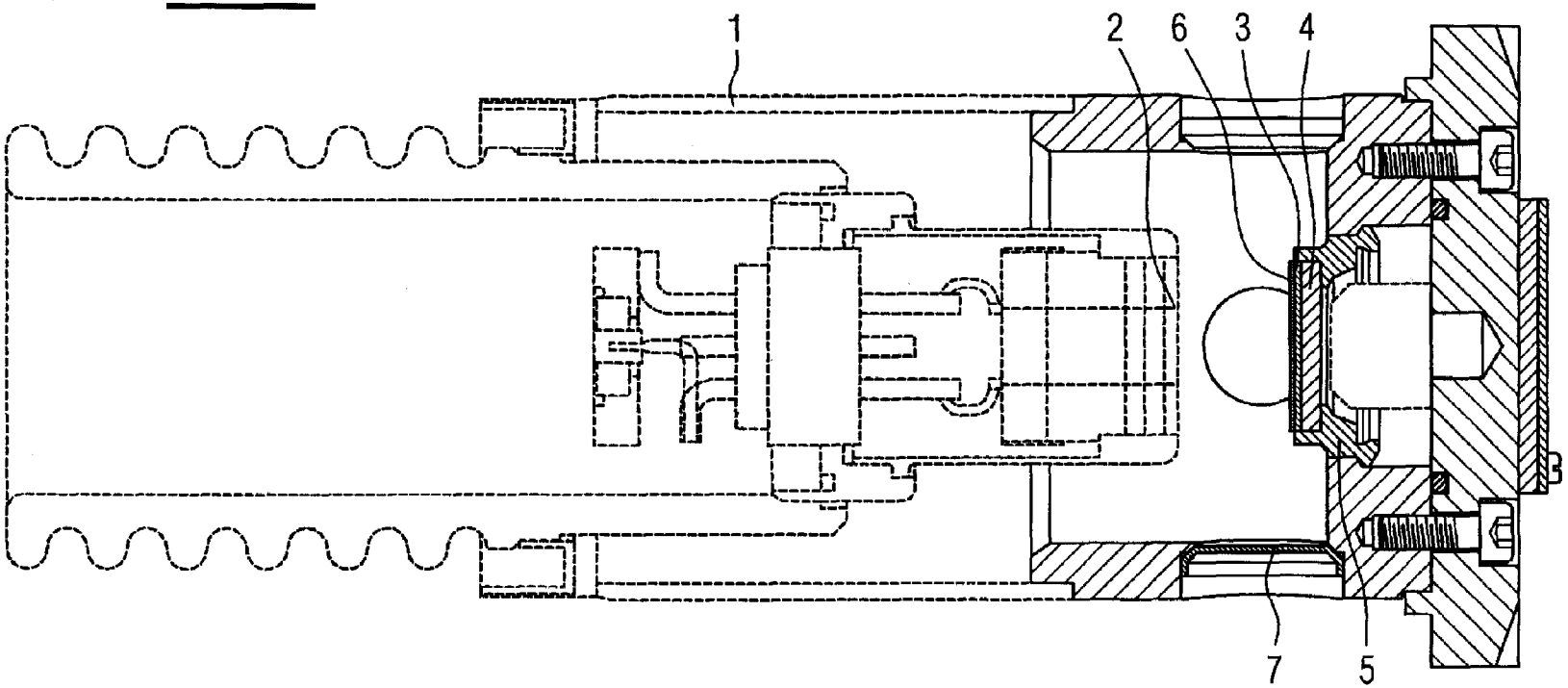
FIG. 1 is a side view, party in section, of a first embodiment of an x-ray tube constructed in accordance with the principles of the present invention, with a fixed anode.

A sectional view of an x-ray tube with a fixed anode is schematically shown in FIG. 1. An anode 3 (for example produced from tungsten) is held in a mount 5 opposite a cathode 2 in a vacuum-sealed housing 1. The mount 5 may be formed of copper. On the anode 3, a heat conductor element 4 is attached on the first side thereof facing away from the cathode 2. The heat conductor element 4 is composed of a material that exhibits a higher heat conductivity in comparison to the anode material. The heat conductor element 4 can be produced, for example, from graphite doped with titanium with a heat conductivity of >650 W/mK. Insofar as the heat conductor element 4 is anisotropic with regard to its heat conductivity, it is attached on the anode 3 such that the direction of the maximum heat conductivity proceeds approximately perpendicularly to the surface of the anode 3.

On its second side facing toward the cathode 2, the anode 3 is provided with a layer 6 produced, for example, from TaC or HfC. The material used for production of the layer 6 exhibits a lower vapor pressure at 800° than the material used for production of the anode 3. As a consequence, ablation of anode material and its unwanted precipitation thereof on the x-ray exit window 7 are prevented.

The layer 6 preferably exhibits a thickness of 300 to 700 nm. For example, it can be applied on the anode 3 by a Sol-Gel method or a PVD method.

Fibers produced from graphite are also suitable for production of the heat conductor element 4. An example of suitable fibers is offered by the company Cytec Engineered Materials GmbH under the mark Thornel® Carbon Fibers. Graphite fibers offered by the same company under the mark Thermal-Graf® are likewise suitable. Plates can be produced from the aforementioned fibers, such plates in turn forming the starting material for production of the heat conductor element 4.

Figure 2:
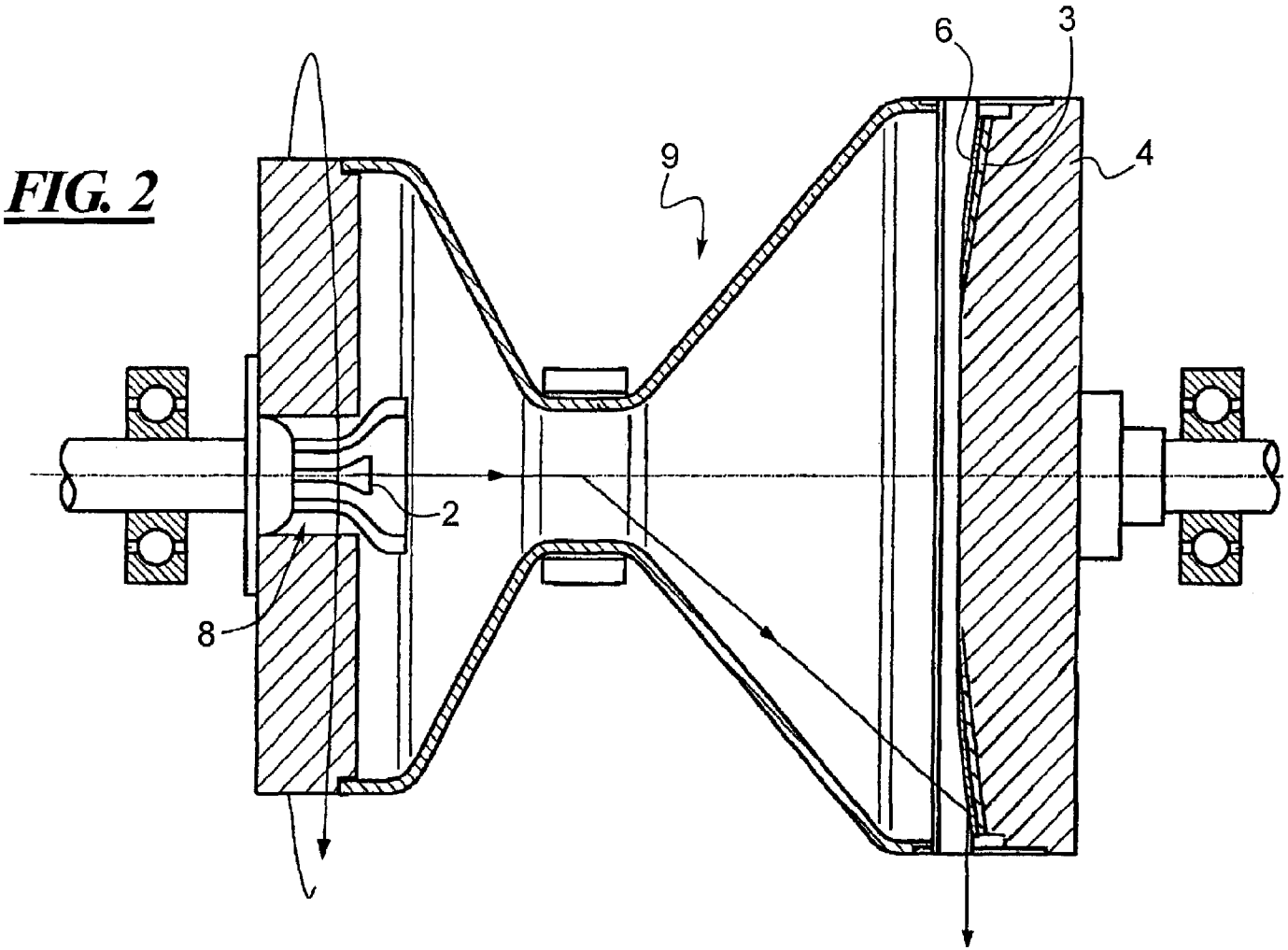
FIG. 2 is a side view, partly in section, of a second embodiment of an x-ray tube constructed in accordance with the principles of the present invention, as a rotary piston x-ray tube.

FIG. 2 shows a further embodiment of an anode constructed in the manner described above in connection with FIG. 1, but embodied in a rotary piston x-ray tube 9. The rotary piston x-ray tube 9 is otherwise of conventional construction, and has a cathode 2 in a cathode assembly 8, as well as the aforementioned anode 3, the heat conductor element 4, and the layer 6.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray tube comprising:

a cathode;

an anode comprising a first material, said anode having a side facing away from the cathode; and a heat conductor element disposed at least in a section of said side of said anode facing away from the cathode, said heat conductor element comprising a second material exhibiting a higher heat conductivity than said first material, for dissipating heat from said anode, said second material comprising graphite doped with titanium exhibiting anisotropic heat conductivity of at least 650 W/mK with a direction of a maximum of said heat conductivity oriented substantially perpendicular to said side of the anode facing away from the cathode.

2. An x-ray tube as claimed in claim 1 comprising a carrier structure at said side of said anode facing away from said cathode, said carrier structure containing said heat conductor element and being comprised of copper.

3. An x-ray tube as claimed in claim 1 wherein said first material is a material selected from the group consisting of Cu, Rh, Mo, Fe, Ni, Co, Cr, Ti, W, and respective alloys predominately containing one of Cu, Rh, Mo, Fe, Ni, Co, Cr, Ti, W.

4. An x-ray tube as claimed in claim 1 wherein said anode has a side facing toward said cathode with focus zone thereon struck by electrons emitted by said cathode, said focus zone being comprised of a third material, said third material exhibiting a lower vapor pressure than said first material at a temperature of 800° C.

5. An x-ray tube as claimed in claim 4 wherein said third material is a material selected from the group consisting of $SiO_2$, $TiO_2$, CrN, TaC, HfC, WC, WB, W, Re, TiB, HfB, TiALN, TiALCN, B, Co, Ni, Ti, V, Pt, Ta.

6. An x-ray tube as claimed in claim 4 wherein said third material comprises $SiO_2$ with filling material selected from the group consisting of C and $TiO_2$.

7. An x-ray tube as claimed in claim 4 wherein said third material forms a layer on said side of said anode facing toward said cathode, said layer having a layer thickness in range between 0.2 μm and 1.0 μm.

8. An x-ray tube as claimed in claim 1 comprising a housing containing said cathode and said anode, and wherein said anode is fixedly mounted in said housing relative to said cathode.

9. An x-ray tube as claimed in claim 1 comprising a housing containing said cathode and said anode, and wherein said anode is rotatably mounted in said housing relative to said cathode.

10. An x-ray tube as claimed in claim 1 comprising a housing that is rotatable relative to said cathode, forming a rotary piston, and wherein said anode is a component of said housing that rotates therewith.

* * * * *